United States Patent [19]

Albiez

[11] Patent Number: 4,466,648

[45] Date of Patent: Aug. 21, 1984

[54] ANIMAL FECES PICK-UP DEVICE

[76] Inventor: Peter Albiez, 434 Millwood Rd., Toronto, Ontario, M4S 1K2, Canada

[21] Appl. No.: 426,181

[22] Filed: Sep. 28, 1982

[51] Int. Cl.[3] ..... A01K 29/00

[52] U.S. Cl. ..... 294/1 BA

[58] Field of Search ..... 294/1 BA, 1 B, 1 R, 294/1 BB, 19 R, 25, 50, 50.5, 50.7, 55; 15/104 R, 104.8, 142, 221, 236 R, 257.1, 257.3; 220/85 R, 85 P, 90

[56] References Cited

U.S. PATENT DOCUMENTS

| | | | |
|---|---|---|---|
| 3,446,055 | 5/1969 | Jones | 294/1 R |
| 3,718,358 | 2/1973 | Ayres | 294/19 R |
| 3,740,086 | 6/1973 | Rossitto | 294/19 R |
| 4,188,055 | 2/1980 | Green | 294/1 R |
| 4,200,319 | 4/1980 | Cooper | 294/1 BA |
| 4,286,816 | 9/1981 | Tobias | 294/1 BA |

*Primary Examiner*—James B. Marbert
*Attorney, Agent, or Firm*—Ridout & Maybee

[57] ABSTRACT

A device for picking-up, containing and removing of malleable wastes is provided. Primarily, the wastes considered are animal fecal matter. The disposable portion of this device is comprised of a mesh element formed into a compartment to contain entrapped feces. Feces are picked up by pressing the matter through the mesh element and into the compartment. Shielding means are provided to retain the fecal matter. A wrapping means such as a bag may be used to further insure containment for disposal into waste bins and the like. An extension handle member with an ejector mechanism is adapted to allow for remote operation of the device.

5 Claims, 6 Drawing Figures

ANIMAL FECES PICK-UP DEVICE

FIELD OF THE INVENTION

The present invention relates to a disposable device for picking-up and disposing of wastes such as animal feces and the like.

BACKGROUND OF THE INVENTION

Animal fecal matter and other equally noxious forms of litter pose a nuisance in modern urban areas. The need to dispose of such materials is increasing along with the apparent rise in the number of pets currently inhabiting urban areas. The containment and disposal of these offensive materials is a matter commonly considered by public authorities and other concerned groups and individuals.

Although many devices have heretofore been proposed, (examples, U.S. Pat. Nos. 3,446,525, 3,718,358, 4,188,055, 4,200,319), some of these devices have utilized relatively complicated designs which are economically unattractive. Other devices which have been proposed require the user to operate them with two hands thereby limiting control of any accompnaying pets. Some of the devices proposed by the prior art disclose designs which by their very nature require the use of significant quantities of materials for construction. Such overuse of materials usually corresponds to significant costs of manufacture. Furthermore, where such designs result in bulky products, the volume of disposable matter for user handling, and ultimately, for municipal disposal is unduly large. Even though the disposable portions of some devices may be constructed from collapsable or compressible materials, it is likely that most users would consider it unpleasant to compress by hand such materials in view of their contents.

The operation of such a device should also allow the user to contain the litter without incurring accidental finger contact. It is also preferred to allow the user to operate the device without necessitating a bending down to ground level in order to effectuate such a procedure.

It is an object of the present invention to provide a device for the containment and disposal of animal feces which allows the user to dispose of the animal fecal matter in a sanitary manner.

It is a further object of the present invention to provide such a device which can be manufactured and operated with relative ease.

It is yet a further object to provide a device which is compact in size by design thereby minimizing material requirements and costs.

Further and other objects of the present invention will become apparent upon perusal of the specifications and drawings herewith included. The preceding objects are attained by a device for picking-up animal feces comprising: a first flexibly resilient, open-mesh element formed from a sheet shaped to present a substantially part cylindrical surface, such surface adapted to be pressed into the feces and to retain the same in the mesh openings; a second imperforate shielding element folded over the open-mesh element, such shielding element having free edges; a stiffening member having an edge extending toward but not touching the inner surface of said substantially part cylindrical surface; fastening means securing the first and second elements together and compressing that part of the imperforate shielding element remote from the part cylindrical surface into a substantially planar handle portion and further securing the said stiffening member within the said planar handle member; and the said free edges defining a surface situated between the said fastening means and a plane lying at a tangent to the part cylindrical surface.

IN THE DRAWINGS

SPECIFIC DESCRIPTION

Figure 1:
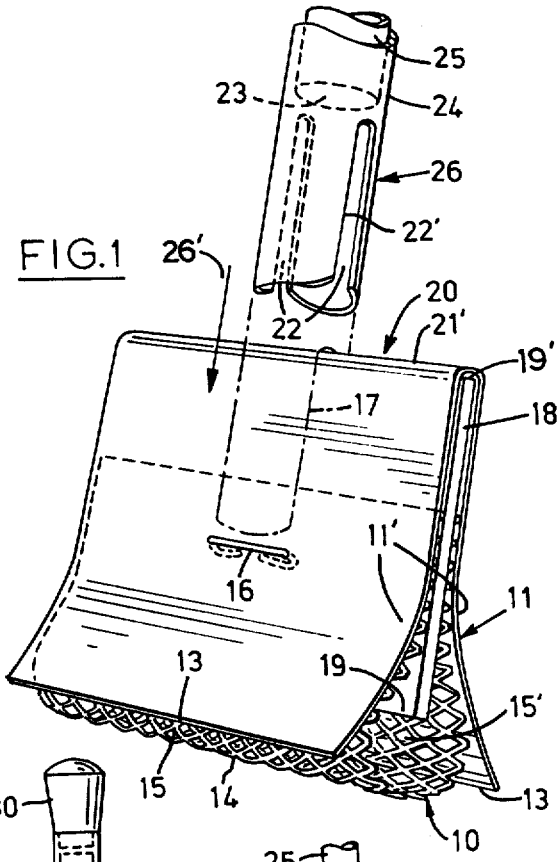
FIG. 1 is a perspective view of a device which embodies features of the present invention. An extension handle member is included in this embodiment.

With reference to FIG. 1, the preferred embodiment of this invention basically comprises two main elements, a disposable mesh element 10, and a remotely operated extension handle 26. The device is assembled by slidably inserting in the direction of arrow 26' a planar handle portion 20 of mesh element 10 into receiving channels 22 of extension handle 26. In the preferred embodiment, frictional contact between the channel wall 22' and the planar handle portion is sufficient to promote the operations hereinafter described. The dashed line 17 indicates the intended position of one remote end of the extension handle after engagement is effected.

The disposable mesh element is comprised of a stiffening member 18, having a remote edge 19 about which a primarily rectangular mesh sheet 15 is adapted to form a chamber 15'. The chamber is meant to be of a size sufficient to receive and contain animal fecal matter without excess matter being forced out of the chamber during the pressing operation described below. A primarily rectangular sheet of impermeable, flexibly resilient material comprises a shield 11 which is adapted to be folded about the other remote edge 19' of the stiffening member to partially encase the stiffening member and the remote edges of the mesh sheet. The shield walls 11', the mesh sheet at a location adjacent to its ends, and the stiffening member are securely bound by fastening means 16.

To minimize costs, materials of construction may include flexibly resilient plastic for the shield and mesh sheet, corrugated cardboard for the stiffening member with a sufficiently large staple to bind the preceding elements. The stiffening member may be used if the other materials chosen are found to otherwise possess insufficient resiliency for the effective operation of the device herein described.

It is preferred that shield edges 13 should be adjacent to a plane tangent to the remote surface 14 of the part cylindrical chamber 15'. The shield walls should be of a length shorter than would have been passed through the adjacent tangent plane. If the shield walls are overly long, they will tend to buckle and otherwise interfere with the effective operation of the device.

The extension handle 26 is shown to have in its preferred embodiment, an outer tubular sleeve 24 in which is slidably operated an inner plunger 25 having a contact end 23. The extension handle is preferred to be of a length convenient to permit a person of average height to effect operation without need to bend or stoop down. The inner plunger is of a length such that in a retracted position, contact end 23 is substantially adjacent to but not exerting substantial pressure on edge 21' of the planar handle portion 10 of the disposable mesh element. Furthermore the thickness of the planar handle portion is sufficient to permit frictional engagement with channel walls 22' to facilitate simple engagement means.

Figure 2:
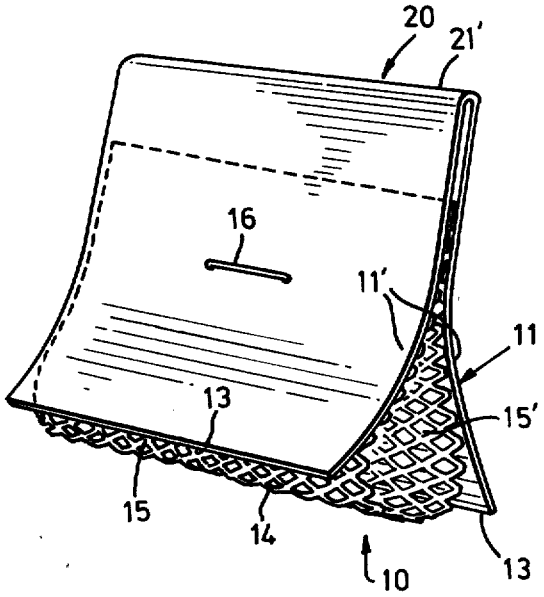
FIG. 2 is a perspective view of another embodiment of the present invention.

With reference to FIG. 2, another embodiment is illustrated essentially comprising the features of the embodiment in FIG. 1, absent a stiffening member. For reasons of economy it is preferred to avoid use of the stiffening member where the materials of construction used in the shield and mesh sheet are sufficiently resilient and resistant to deformation to permit proper operation of the invention.

Figure 3:
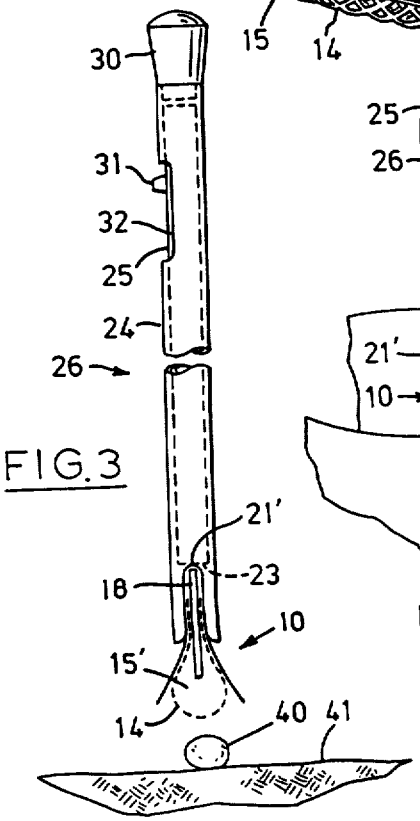
FIGS. 3, 4 and 5 are perspective views showing the sequential stages in the operation of the feces pick-up device envisioned by this invention.
Figure 4:
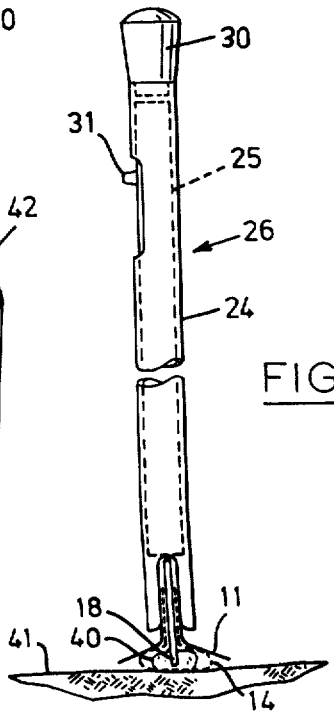

FIGS. 3 and 4 show how one embodiment of the invention may be used to receive and contain animal fecal matter 40 lying on a surface 41. The extension handle 26 is shown in a compressed view. An ejector knob 31, situated in a slot 32 of a length approximately equal to the length of the receiving channels 22, is provided to operate the inner plunger 25. A knob 30 may be used to improve the gripping characteristics of the extension handle.

By pressing down the mesh surface 14 upon the fecal matter until the fecal matter has substantially entered the chamber by extrusion through the mesh openings, engagement occurs. The device is thereafter lifted away from the surface 41 and taken to a trash receptacle 42 as shown in FIG. 5.

Figure 5:
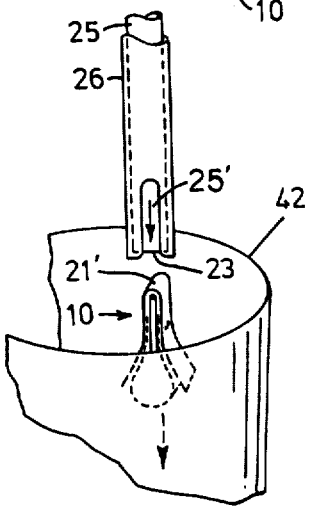

In FIG. 5, plunger 25 has been activated in the direction of arrow 25' to force the disposable mesh element from the receiving channel by means of force exerted by contact end 23 engaging with remote edge 21 of the planar handle portion.

Figure 6:
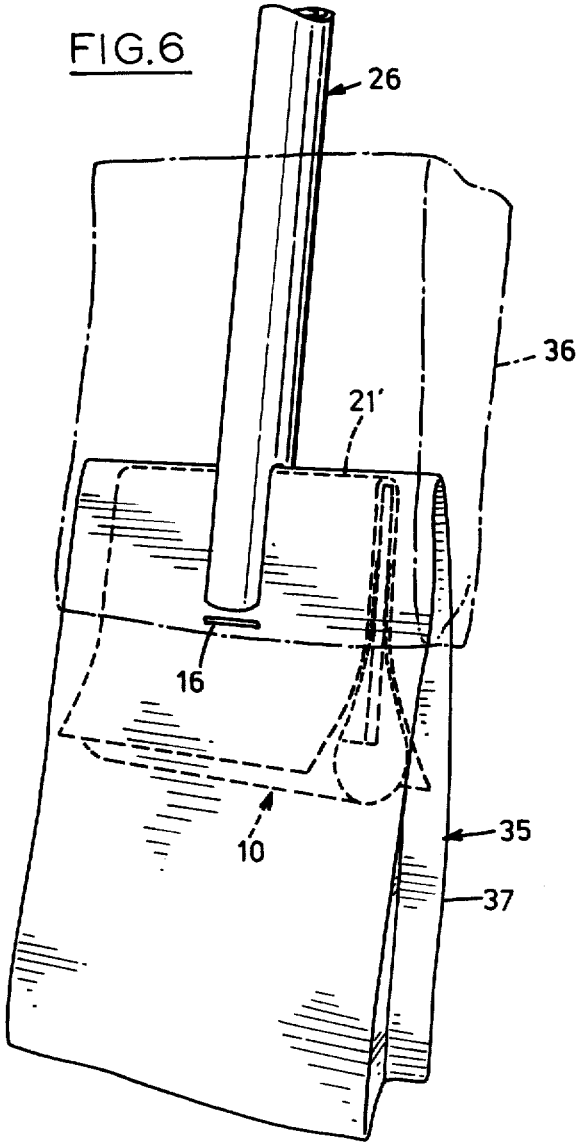
FIG. 6 shows one embodiment of the present invention which provides a wrapping means such as a bag or the like for sanitary containment of its contents.

With reference to FIG. 6, a wrapping means 35 has been used in an embodiment for sanitary disposal of the disposable mesh element and its contents. In the preferred embodiment, a bag of sufficient volumetric size may be fastened to the other elements by the single fastening means 16. The closed end of the bag is used to encase the remote end of the disposable mesh element, corresponding to 21', such that the receiving channel of the extension handle would engage with part of the outer wall of the bag. Prior to pressing the mesh element into contact with the subject matter, the bag is turned inside out and upwardly away from the disposable mesh element to a position corresponding to the dashed line 36. After use, the bag may be returned to the position corresponding to 37 for sealing of the bag with contents. It is obvious that the bag should be sufficiently large to avoid accidental finger contact with the spent device during the operational steps.

What I claim is:

1. A device for picking-up animal feces comprising:

a first flexibly resilient, open-mesh element formed from a sheet shaped to present a substantially part cylindrical surface, such surface adapted to be pressed into the feces and to retain the same in the mesh openings;

a second imperforate shielding element folded over the open-mesh element, such shielding element having free edges;

a stiffening member having an edge extending toward but not touching the inner surface of said substantially part cylindrical surface;

fastening means securing the first and second elements together and compressing that part of the imperforate shielding element remote from the part cylindrical surface into a substantially planar handle portion and further securing the said stiffening member within the said planar handle member;

and the said free edges defining a surface situated between the said fastening means and a plane lying at a tangent to the part cylindrical surface.

2. A device as claimed in claim 1 having an extension handle, said extension handle having a slot for slidable attachment to said planar handle member.

3. A device as claimed in claim 2 wherein the said extension handle member includes a remotely operated reject sliding rod adapted to dislodge the said substantially planar handle portion from the said slot.

4. A device as claimed in claim 3 having wrapping means adapted for sanitary containment of animal feces.

5. A device as claimed in claim 4 wherein the said wrapping means is a bag fastened to the said planar handle member by the said fastening means and adapted to enclose the device.

* * * * *